United States Patent [19]

Bryden et al.

[11] 4,059,910

[45] Nov. 29, 1977

[54] FOOTWEAR APPARATUS

[76] Inventors: Kenneth Bryden, 1525 G & H Drive, Kissimmee, Fla. 32741; Norman C. Barrett, 18 Sea Gull Drive, Vero Beach, Fla. 32960

[21] Appl. No.: 753,633

[22] Filed: Dec. 23, 1976

[51] Int. Cl.[2] ..... A43B 13/00; A43B 3/12; A43D 0/00

[52] U.S. Cl. ..... 36/103; 36/11.5; 12/146 B

[58] Field of Search ..... 36/86, 103, 31, 44, 36/11.5, 100, 101; 2/DIG. 6; 12/142 S, 146 B

[56] References Cited

U.S. PATENT DOCUMENTS

| | | | |
|---|---|---|---|
| 500,385 | 6/1893 | Hall | 36/103 |
| 1,675,865 | 7/1928 | Pfestroff | 12/146 B |
| 2,364,691 | 12/1944 | Cagney | 12/146 B |
| 2,370,963 | 3/1945 | Issaly | 12/146 B |
| 2,658,288 | 11/1953 | Scholl | 36/44 |
| 3,686,779 | 8/1972 | Sachs | 36/101 |

*Primary Examiner*—Patrick D. Lawson
*Attorney, Agent, or Firm*—Duckworth, Hobby & Allen

[57] ABSTRACT

A sandal for wearing on the foot is provided having a plurality of elongated, wooden slats having their ends shaped to form the bottom of a sandal or shoe. The slats are held together by a flexible piece of material glued to one side thereof and a flexible sandal or shoe upper portion may be attached to the top of the flexible material holding the slats together to form a sandal.

9 Claims, 3 Drawing Figures

FOOTWEAR APPARATUS

BACKGROUND OF THE INVENTION

The present invention relates to footwear and especially to informal footwear, such as sandals, which have a plurality of wooden members held together to form the sole and heel portion of the sandal.

In the past, it has been common to provide a wide variety of footwear to cover the feet or portions of the feet of individuals for the protection of the feet. Common footwear today is made of leather, rubber, or synthetic materials, but it has been common in some countries, in the past, to provide wooden shoes. In addition, it has been suggested to make the sole or heels of shoes of wood. Inasmuch as wood or similar materials are not flexible, such footwear can be difficult to walk upon, but wood has been used in recent years to form portions of the heels of women's shoes as well as the bottoms of certain types of sandals. To make wood more flexible, sandals have been provided which have the wood broken into sections, which are held together so that the sections can bend from one to the other. In contrast to these, the present invention is directed towards shoes having a plurality of slats connected similar to tambour doors in which the slats are shaped to form the bottom of the shoe. Each of the slats has a generally square or rectangular cross-section except for the toe and heel portions which are curved to conform to the shoe. The large number of slats can thereby separate over their length by the bending of the flexible material holding the slats together. The flexing of the shoes tends to make a clacking type of noise, which tends to appeal to certain purchasers of shoes. The shoes also allow for a wide variety of uppers to be attached to make a wide variety of sandals from the same sole and heel portions.

SUMMARY OF THE INVENTION

A footwear apparatus of the sandal type has a plurality of elongated, wooden slat members, each shaped to support an adjacent member and having a predetermined shape to collectively form a foot support. A pair of end, elongated wooden members are shaped to conform to a toe and heel of a sandal. A flat, flexible connecting member is attached to one side of each of the wooden members to hold the wooden members together in a spaced relationship and to allow a separation of the wooden members when the flexible member is flexed. An upper footwear portion is attached to the flexible connecting member connecting the wooden slats to allow attaching to the foot of a user. The upper footwear portion can have an additional, flexible member covering the original flexible member, to provide additional strength to the shoe. The flexible members may be glued to the wooden slats and to each other with an epoxy or similar adhesive.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
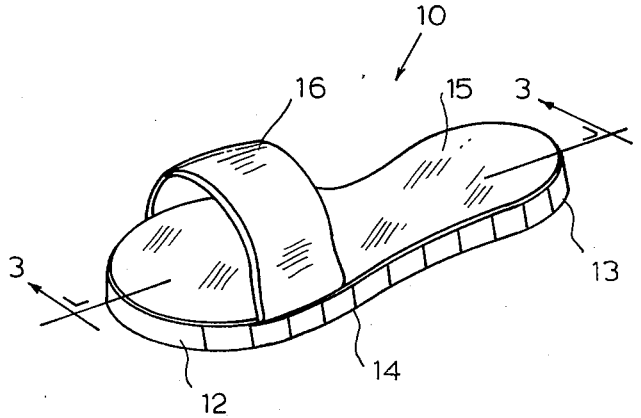
FIG. 1 is a perspective view of a sandal in accordance with the present invention.
Figure 2:
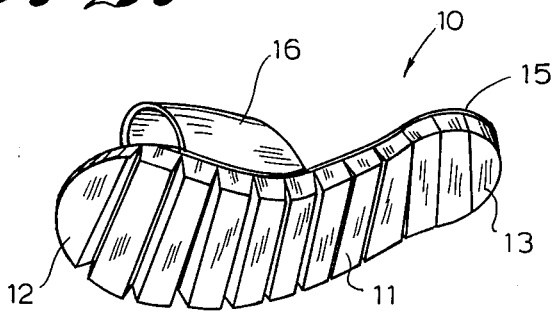
FIG. 2 is a bottom view of the sandal in accordance with FIG. 1.
Figure 3:
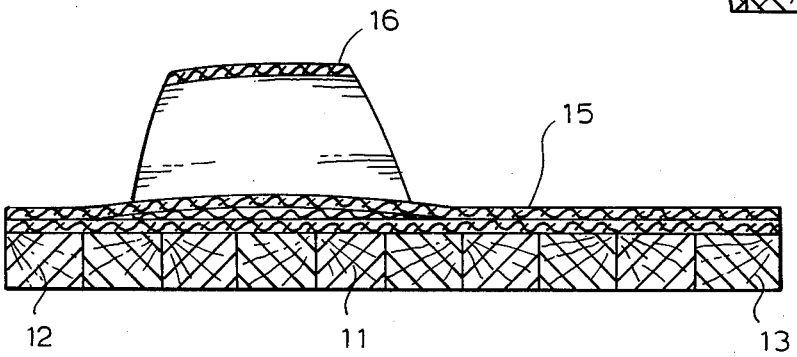
FIG. 3 is a sectional view taken on Line 3—3 of FIG. 1.

Referring now to the FIGS. 1 through 3 of the drawings, a sandal 10 is illustrated having a plurality of wooden slat members 11 each having the same general cross-section, but each having a different end shape so as to form a generally shoe-sole shape. A toe end slat member 12 has a different cross-section, as does a heel slat member 13 which may be curved to conform to the toe and heel of the sandal. The wooden slats 11 are held together by a flat, flexible portion 14, which may be ordinary duck cloth, leather or a synthetic material, as desired, without departing from the spirit and scope of the invention. The cloth 14 may be held to the slats 11 by a epoxy or similar type adhesive. A sandal upper portion 15 is also shaped to conform to the portion 14 and to the slats 11, 12, and 13, and may be glued to the cloth 14 with an adhesive. This upper member may be made of leather, or of a polymer material, or of any flexible material desired, and may have attached thereto a foot attaching and support portion 16 made of the same material or another material as desired, which can be folded to extend between the flat portions 14 and 15, so as to be glued therebetween when the two are attached to each other. It will, of course, be clear that the flat foot portion 15 and 16 can have any combination of color of material desired, which can be easily modified to provide a variety of sandals attached to the same common base formed from the slats 11, 12 and 13, and flexible connecting material 14. When the bottom 14 and 15 are flexed, such as when walking, the slats 11, 12 and 13, separate as seen in FIG. 2, and can be made to provide a clacking noise by the rapid flexing of the shoes, either on or off the foot. The shoes may be, advantageously, rolled or folded for packing in a bag or for packaging or shipping.

Figure 4:
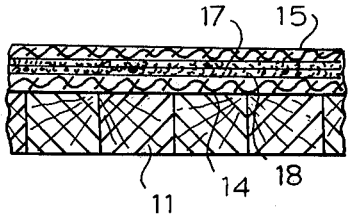
FIG. 4 is a sectional view of a second embodiment in accordance with the present invention.

FIG. 4 shows a second embodiment having the sandal upper portion and flexible binding each having one portion of a hook and loop material, such as velcro, attached thereto with an adhesive. This allows for a quick change of the upper portion 15 to different soles to match different clothing or for color combination. The hook portion 17 is attached to the upper portion 15 and the loop portion 18 is attached to the flexible, binding material 14, or may replace the binding 15 if desired.

It should be clear, at this point, that a sandal has been provided which allows the production of a wide variety of sandals from the same basic combination of wooden slats connected together in a predetermined manner. It should, however, also be clear that other variations and changes are contemplated as being within the scope of the invention, which is not to be construed as limited to the particular forms disclosed herein.

I claim:

1. A footwear apparatus comprising in combination:

a plurality of elongated wooden members of a generally uniform cross-section, each shaped to receive an adjacent member, and having a predetermined shape to collectively form a foot support;

a pair of end elongated wooden members shaped to form the toe and heel end members of a foot support;

flexible connecting means attached at one side of each wooden member to hold said wooden members together in a spaced relationship to each other and to allow separation of said wooden members when said flexible connecting means is flexed;

an upper footwear portion attached to said flexible connecting means to attach said flexible means and wooden members to a wearer's foot, thereby providing a piece of footwear, said upper footwear portion having a flat flexible portion having the same general shape as the flexible connecting means, and forming a pair of flexible portions connecting to said plurality of elongated wooden members; and said upper footwear portion flat flexible portion also having one portion of a hook and loop material attached thereto and said flexible connecting means is a second portion of a hook and loop material whereby said upper footwear portion and said wooden members can be removably attached to each other.

2. The footwear apparatus in accordance with claim 1, in which said flexible, connecting means is a cloth material, and said flat portion of said upper footwear portion is leather.

3. The apparatus in accordance with claim 1, in which said flexible, connecting means is formed of a cloth material and said flat, flexible portion of said upper footwear portion is a flexible polymer material.

4. The footwear apparatus in accordance with claim 1, in which a foot attaching portion is connected between said one portion of said hook and loop material and the flexible flat portion of the upper footwear portion, and extends above the flat portion of a upper footwear portion to conform to the general shape of a foot placed therein.

5. The footwear apparatus in accordance with claim 4, in which each of the plurality of elongated wooden members has a generally square cross-section.

6. The apparatus in accordance with claim 5, in which the pair of end elongated wooden members form an elongated arcuate surface, intersecting a flat surface adjacent one of said plurality of elongated, wooden members.

7. The apparatus in accordance with claim 6, in which each of said plurality of elongated wooden members and each of said pair of end elongated wooden members form a pair of flat surfaces having said flexible connecting means attached thereto.

8. The apparatus in accordance with claim 7, in which said flexible connecting means is attached to said plurality of elongated wooden members and said pair of end elongated wooden members with an epoxy type adhesive.

9. The apparatus in accordance with claim 1, in which said upper footwear portion flat flexible portion has one portion of a hook and loop material attached thereto and said flexible connecting means has the other portion of said hook and loop material attached thereto whereby the upper footwear portion is removably attached.

* * * * *